United States Patent [19]

Buehler

[11] Patent Number: 4,610,374

[45] Date of Patent: Sep. 9, 1986

[54] APPARATUS FOR MIXING FLOWABLE MATERIALS IN SEALED CONTAINERS

[75] Inventor: John D. Buehler, Bridgeton, N.J.

[73] Assignee: Dougherty Brothers Company, Buena, N.J.

[21] Appl. No.: 665,585

[22] Filed: Oct. 29, 1984

[51] Int. Cl.[4] ..... B67B 7/24

[52] U.S. Cl. ..... 222/83; 222/189; 222/482; 141/329; 604/412; 604/414; 604/416; 220/371; 206/222

[58] Field of Search ..... 222/189, 481, 482, 332, 222/442, 484, 83, 80, 81; 141/329, 330, 19, 21, 22, 29; 604/414, 412, 411, 415, 416, 405; 220/367-374; 206/222

[56] References Cited

U.S. PATENT DOCUMENTS

| | | | |
|---|---|---|---|
| 2,112,125 | 3/1938 | Von Bultzinglowen | 222/519 |
| 2,808,178 | 10/1957 | Digrado et al. | 222/484 |
| 2,953,132 | 9/1960 | Richter et al. | 128/272 |
| 3,542,240 | 11/1970 | Solowey | 222/83 |
| 3,734,098 | 5/1973 | Schneller et al. | 128/272 |
| 3,776,229 | 12/1973 | McPhee | 222/442 |
| 3,788,369 | 1/1974 | Killinger | 141/330 |
| 4,296,786 | 10/1981 | Brignola | 141/329 |
| 4,332,333 | 6/1982 | Linsey | 222/83 |
| 4,396,016 | 8/1983 | Becker | 222/481 |
| 4,432,760 | 2/1984 | Mittleman et al. | 604/405 |
| 4,532,969 | 8/1985 | Kwaan | 141/29 |

*Primary Examiner*—Joseph J. Rolla
*Assistant Examiner*—Louise S. Hein
*Attorney, Agent, or Firm*—Seidel, Gonda, Goldhammer & Abbott

[57] ABSTRACT

A first container having a first material therein has a piercing tip on a dispensing member which is movable relative to the container to control flow from the container. The first container has a movable portion for facilitating introduction of air into the container. A second container having a second material therein has an inlet and an outlet. The inlet is closed and adapted to be pierced by said tip to facilitate introduction of the first material into the second container.

7 Claims, 5 Drawing Figures

APPARATUS FOR MIXING FLOWABLE MATERIALS IN SEALED CONTAINERS

BACKGROUND OF THE INVENTION

There is a need for apparatus for mixing flowable materials in a manner which is sterile, which overcomes the common problem of "air lock", while providing containers which are tamper-evident. The present invention is directed to a solution of those problems.

SUMMARY OF THE INVENTION

The present invention is directed to apparatus for mixing flowable materials in two discrete sealed containers. The first container has a first material therein and a dispensing member terminating in a piercing tip. The dispensing member is movable relative to the first container to selectively control flow from the first container. The first container has a movable portion for facilitating introduction of air into the container to replace material dispensed therefrom. A second container is provided and having a second material therein. The second container has an inlet which is closed and adapted to be opened by the piercing tip on the first container to facilitate introduction of the first material into the second container.

It is an object of the present invention to provide apparatus for mixing flowable materials in a manner which is sterile, overcomes the problem of airlock, and provides containers which are tamper-evident.

Other objects and advantages will be set forth hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
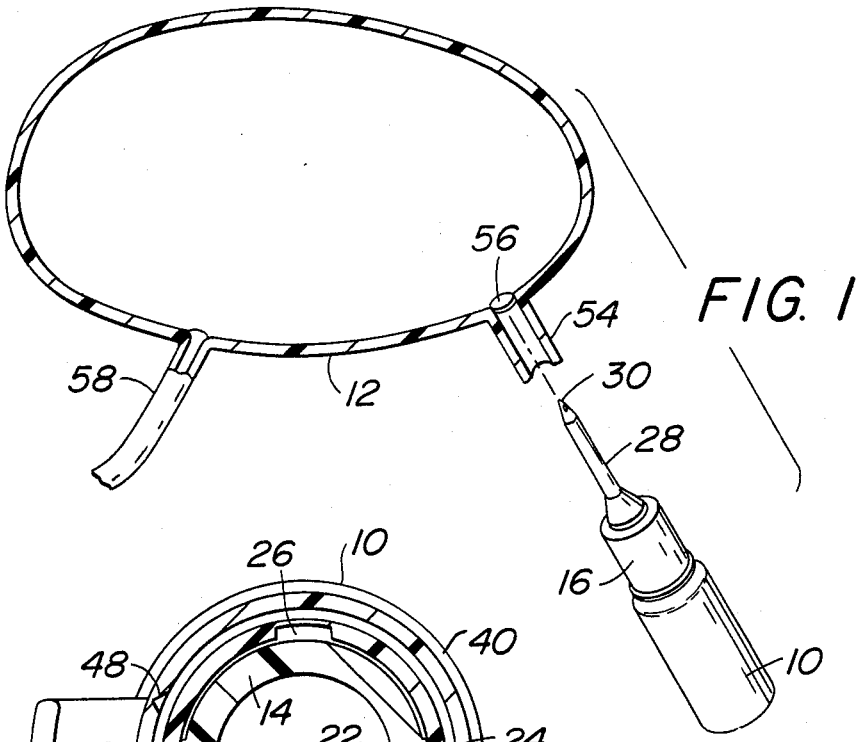
FIG. 1 is an exploded view of the first and second containers each containing materials to be mixed.

Referring to the drawings in detail, wherein like numerals indicate like elements, there is shown in FIG. 1 a first container 10 and a second container 12. As shown more clearly in FIG. 2, the first container 10 has a neck 14 at its outlet. Neck 14 has integral beads on its outer periphery snapped over beads on the inner periphery of a closure 16. A major portion of the neck 14 beginning at the outlet end thereof is free of beads so as to be smooth.

The closure 16 has an inner annulus 18 integral in one piece therewith and connected to the outer portion by a bight 19. The lower end of the annulus 18 is provided with a seal 20 integral in one piece therewith and connected thereto by a weakened or thinned peripheral portion. Annulus 18 and closure 20 form a well radially inwardly of and in frictional contact with the inner surface of the neck 14.

Figure 3:
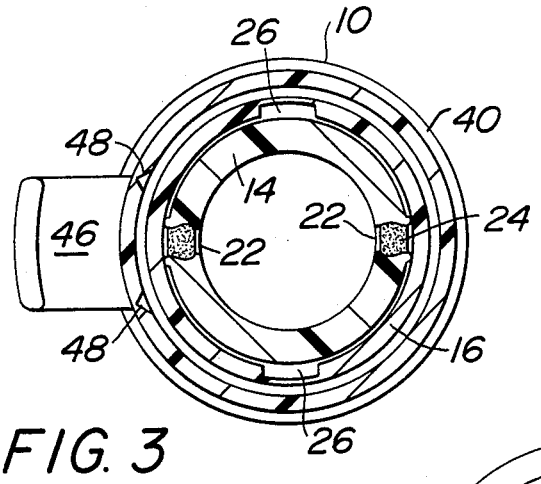
FIG. 3 is a sectional view taken along the line 3—3 in FIG. 2.

Beneath the elevation of the seal 20, and above the elevation of the threads thereon, the neck 14 has one or more radially disposed openings 22. Within the opening 22, there is provided on a shoulder thereof a sterilized air filter 24. The inner periphery of the outer portion of closure 16 in the area of the threads thereon is provided with an axially extending groove 26 for each opening 22. As shown in FIG. 3, there is illustrated two grooves 26 diametrically opposite one another with the number of grooves corresponding to the number of openings 22. The outer peripheral surface of closure 16 is preferably roughened so as to provide for a good gripping surface. At the appropriate time as will be explained hereinafter, closure 16 is rotated relative to the container 10 so that each groove 26 may be aligned with an associated opening 22. Rotation of closure 16 does not result in axial movement thereof. Each groove 26 is open at its lower end so that environmental air may flow upwardly therethrough and into the container 10.

Figure 2:
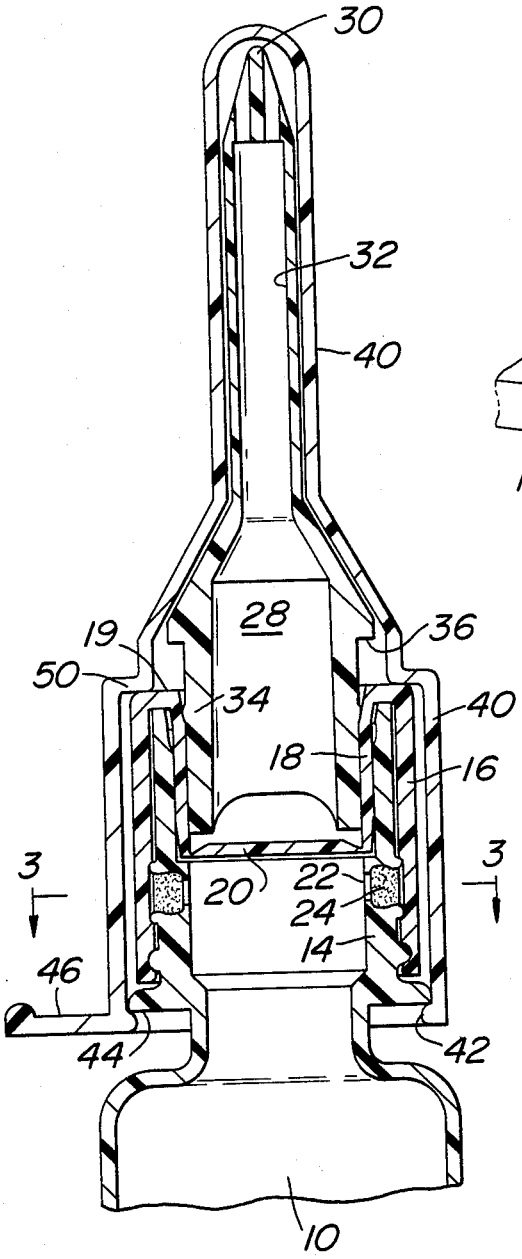
FIG. 2 is a vertical sectional view of the upper end of the first container.

The container 10 is provided with a dispensing member designated generally as 28. Member 28 has an axially extending flow passage 32 and a cylindrical barrel 34 at its lower end. At its upper end, the member 28 is provided with a piercing tip 30. Between tip 30 and barrel 34, the member 28 is provided with a shoulder 36. The shoulder 36 is spaced from the bight 19 as shown in FIG. 2. At its lower end, as shown more clearly in FIG. 4, the barrel 34 has a piercing wedge 38 integral in one piece therewith. Wedge 38 is provided on a small segment of the lower periphery of the barrel 34 and is aligned with a peripheral portion of the seal 20.

The dispensing member 28 is provided with a tamper-evident shield 40. Shield 40 is telescoped over the dispenser member 28 and the closure 16. At its lower end, the shield 40 has a bead 42 which is snapped under a radially outwardly extending flange 44 on the neck 14. Outwardly from the bead 42, the shield 40 has a pull tab 46. In the area of the pull tab 46, the shield 40 is provided with one or more weakened zones 48. See FIG. 3. The weakened zones 48 readily tear or break when pull tab 46 is manipulated to facilitate removal of the shield 40. Whenever shield 40 is removed from the container 10, and then replaced, there is visible evidence of tampering with the contents of container 10. Shield 40 has a shoulder 50 which engages bight 19 so that pressure on shield 40 cannot move member 28 in an axial direction.

Figure 4:
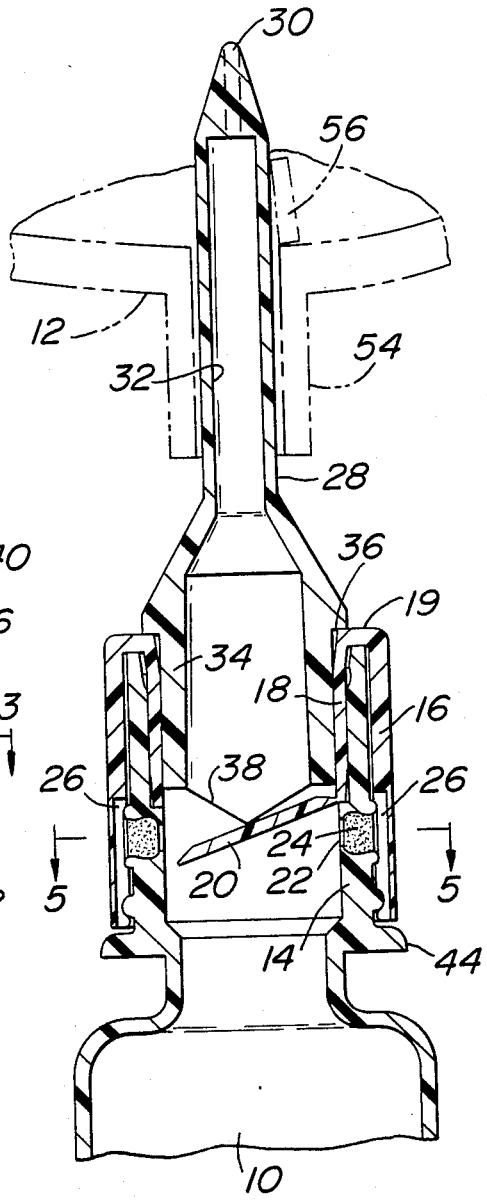
FIG. 4 is a vertical sectional view of the first container with components in a dispensing position and with the second container shown in phantom.

Referring to FIGS. 1 and 4, the second container 12 has an inlet tube 54 open at its free end and closed at its other end which is integral in one piece with the container 12. At the location where inlet tube 54 joins the container 12, the flow passage through tube 54 is closed by a disc 56. Disc 56 has at least a major portion of its periphery weakened or thinned where it joins the container 12. Container 12 is preferably also provided with an outlet 58 which may be separate and discrete from the inlet tube 54.

There are a wide variety of circumstances wherein it is desirable to mix the materials of containers 10 and 12 just prior to usage. One such circumstance is when the materials have a substantially longer shelf life so long as they are not mixed. By way of example, the material within container 12 may be water and the material within container 10 may be a salt solution and when mixed, provides a saline solution, emulsion, mixture, etc. Alternatively, the solution may be an intravenous nutrition solution containing nutrients such as glucose, amino acids, vitamins containing one or more of potassium, calcium, magnesium, and phosphates; and or medication.

The method of using the containers 10 and 12 is as follows. At the time when it is desired to mix the material in container 10 with the material in container 12, an upward pulling force is exerted on the pull tab 46 whereby the shield 40 tears or breaks along the zone 48. Thereafter, shield 40 is readily removable. Dispensing member 28 is inserted through the tube 54 until the piercing tip 30 pierces the disc 56. A small portion of disc 56 remains integral with the container 12 whereby the disc cannot mix with the materials within container 12. See FIG. 4.

Figure 5:
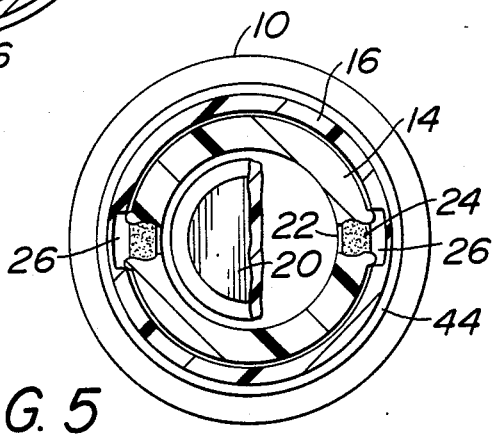
FIG. 5 is a sectional view taken along the line 5—5 in FIG. 4.

Thereafter, the dispensing member 28 is moved in an axial direction until the wedge 38 pierces the seal 20 as shown in FIG. 4 and shoulder 36 engages bight 19. The material in container 10 is introduced into container 12 in any convenient manner such as by elevating container 10 so that the material flows due to gravity, or by squeezing the container 10 which is sufficiently flexible so as to cause the material therein to enter container 12. Thereafter, the closure 16 is rotated from the position shown in FIG. 3 to the position shown in FIG. 5. Environmental air enters the container 10 via groove 26 and opening 22 to replace the material which has been dispensed. Any such air entering the container 10 is cleansed of dust or other particles by the filter 24. The air entering container 10 expands the same to its original condition and enters the second container 12. Thereafter, the solution, emulsion, or mixture of the first and second materials may be discharged through outlet 58 or discharged through tube 54 after removal of member 28 from tube 54. If desired, container 12 may be subjected to a shaking step to provide intimate mixing before dispensing from container 12.

If desired, the inner periphery of the lower cylindrical portion of the shield 40 may have axially extending V-shaped beads whose apex is in frictional contact with the annulus 18 on the closure 16. To facilitate alignment of groove 26 with the hole 22, an indicator mark is preferably provided on the outer peripheral surface of flange 44 and a similar indicating mark is provided on the outer periphery of closure 16 adjacent the location of groove 26. Groove 26 will be aligned with opening 22 when the indicator marks are aligned with each other. In most situations, container 10 will be substantially smaller than container 12 as illustrated in the drawings. However, it is within the scope of the present invention to utilize containers of different sizes than that illustrated. In order that the lower end of groove 26 may communicate with the atmosphere, the bead 42 is interrupted at the location of the groove 26.

In view of the above description, it will be noted that the first and second materials are capable of being mixed in a sterile manner with the first container having means for indicating tampering and means for preventing an airlock.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus for use in mixing flowable materials comprising a first container having a first material therein adapted to be mixed with a second material in a second container, said first container having a hollow dispensing member coaxial therewith and terminating in a piercing tip at one end thereof, said dispensing member being movable in an axial direction relative to said first container to selectively control flow from said first container, said first container having a portion movable in a circumferential direction for facilitating introduction of air in a radial direction into the first container to replace material dispensed therefrom, and a shield telescoped over said dispensing member and said movable portion, said shield protecting said dispensing member from movement relative to said first container while said shield is attached to said first container.

2. Apparatus for mixing flowable materials in two discrete sealed containers comprising:

(a) a first container having a first material therein; a closure sealing said first container; a dispensing member terminating at one end in a piercing tip and mounted on said first container in axial alignment therewith, said member being separate from said closure and having an end opposite said piercing tip constructed and arranged upon axial movement of said member to pierce said closure thereby to allow for flow of said first material from said first container, and said closure being circumferentially rotatable relative to said container and constructed such that circumferential rotation thereof permits introduction of air into the first container to replace the first material displaced therefrom; and (b) a second container having a second material therein, said second container having an inlet and an outlet, said inlet being closed and adapted to be opened by said piercing tip to facilitate introduction of said first material into said second container.

3. Apparatus in accordance with claim 2 wherein said closure has a flow passage, said container having an opening radially inwardly of said closure and adapted to be aligned with said flow passage in one position of said closure, and a filter for filtering air entering the first container through said opening and flow passage.

4. Apparatus in accordance with claim 2 wherein said inlet on said second container is a tube closed at one end by a disc adapted to be pierced by said tip.

5. Apparatus in accordance with claim 2 including a shield telescoped over said piercing tip and said closure, and said shield having a pull tab connected thereto by a weakened zone to provide evidence of tampering.

6. Apparatus in accordance with claim 2 wherein said closure for said first container includes an outer annulus snapped onto the first container and being integral in one piece with a well within the outlet of the first container, said dispensing member being partially disposed in said well, the bottom wall of said well constituting a seal adapted to be opened by said movement of said dispensing member.

7. Apparatus in accordance with claim 1 including a peripheral bead on said container, one end of said shield being snapped under said bead.

* * * * *